United States Patent [19]

Mueller

[11] Patent Number: 4,541,833

[45] Date of Patent: Sep. 17, 1985

[54] COAL COMPOSITION

[76] Inventor: Warren B. Mueller, 11814 Coursey Blvd., Suite 324, Baton Rouge, La. 70816

[21] Appl. No.: 594,293

[22] Filed: Mar. 28, 1984

[51] Int. Cl.[4] ..... C10L 5/10

[52] U.S. Cl. ..... 44/16 R; 44/15 R

[58] Field of Search ..... 44/15 R, 6, 16 R, 17, 44/24, 16 C

[56] References Cited

U.S. PATENT DOCUMENTS

| | | | |
|---|---|---|---|
| 2,890,945 | 6/1959 | Dohmen | 44/15 R |
| 3,563,714 | 2/1971 | Brewer | 44/24 X |
| 4,169,711 | 10/1979 | Anderson | 44/16 R X |
| 4,225,317 | 9/1980 | Kugel | 44/6 |
| 4,260,395 | 4/1981 | Anderson | 44/16 C |
| 4,264,333 | 4/1981 | Shaw et al. | 44/6 |
| 4,282,004 | 8/1981 | Masologites | 44/15 R X |
| 4,302,210 | 11/1981 | Duncan | 44/24 |
| 4,326,854 | 4/1982 | Tanner | 44/24 X |
| 4,331,446 | 5/1982 | Draper et al. | 44/6 X |
| 4,331,447 | 5/1982 | Kamada et al. | 44/6 X |
| 4,369,042 | 1/1983 | Schafer et al. | 44/15 R |
| 4,417,899 | 12/1981 | Morris | 44/6 |

FOREIGN PATENT DOCUMENTS

| | | | |
|---|---|---|---|
| 652270 | 2/1965 | Belgium | 44/16 |
| 0073080 | 6/1982 | Japan | 44/24 |
| 0131289 | 8/1982 | Japan | 44/15 R |

*Primary Examiner*—D. E. Gantz
*Assistant Examiner*—Glenn A. Caldarola
*Attorney, Agent, or Firm*—David L. Ray

[57] ABSTRACT

This invention relates to a quick drying and setting coal binding system which comprises (a) an aqueous solution of $SiO_2/Na_2O$ or $SiO_2/K_2O$; (b) a water soluble surfactant; and (c) an organic ester.

9 Claims, No Drawings

COAL COMPOSITION

BACKGROUND OF THE INVENTION

Of all the energy resources on earth one of the most abundant is coal. It is estimated, at todays rate of use, the world's coal supply could last 300 to 400 years. Not only is the supply of coal great but its heating value to cost ratio is favorable.

Despite the positive aspects of coal there is one seemingly overriding factor which prevents its wide spread use, i.e., coal pollutes the atmosphere upon burning. Of particular concern is its $SO_2$ pollution which has been linked to the phenomenon of acid rain. The level of $SO_2$ produced upon burning is apparently directly proportional to the sulfur content of the coal. It is a commonly accepted industry standard that coal which contains more than one percent sulfur is to be labeled a medium or high sulfur content coal depending upon the extent which the sulfur content exceeds one percent for the particular coal being graded. Low sulfur coal, of course, contains less than one percent sulfur. A typical low sulfur coal is Eastern Kentucky Cannel Coal. As would be expected, low sulfur coals are in great demand by the utility, metallurgical, and other coal consuming industries. This great demand places a premium price on low sulfur coal.

The mining, processing, storage and transport of coal, due to its relatively fragile nature, produces waste which is composed of coal pieces of small size, i.e., an apparent diameter of less than $\frac{3}{4}$ inch. This waste coal, especially if it is a low sulfur coal, would have a high value if it could be reconstructed back to a usable size without deleteriously effecting its burning or emission characteristics. Such reconstruction entains the development of coal compositions which include, besides the coal, a binder to hold the small coal pieces together so that the reconstructed coal can withstand shipping and burning without premature crumbling. Several candidate compositions are disclosed in U.S. Pat. Nos. 4,331,446; 4,260,395; 4,169,711 and 4,417,899. U.S. Pat. No. 4,302,210 teaches the manufacture of a fuel log from sawdust, charcoal powder, and wax binder. While the candidate compositions may have utility if the coal component is a porous, soft coal, it is not certain they would be useful if the coal component is a hard, smooth, non-porous coal such as the before mentioned low sulfur Cannel Coal. Further, the candidate compositions, to be successful in a high tonnage commercial process, would have to have a high speed binding characteristic. Even though no testing of these candidate compositions has been performed, it is suspected they would not exhibit the high speed binding sought for the type of commercial production to which the subject invention is directed.

It is therefore an object of the invention to provide a coal composition for use in the high speed commercial reconstruction of waste coal. It is a further object of this invention to provide a coal composition having high utility even if the coal component is a hard, smooth, non-porous coal such as Cannel Coal.

THE INVENTION

This invention relates to a coal composition which includes coal and a binder system which comprises: (a) $Na_2SiO_3$ or $K_2SiO_3$ which is initially an aqueous $SiO_2/Na_2O$ or $SiO_2/K_2O$ solution; (b) a water soluble surfactant; and (c) a common organic ester or mixture of esters having the formula,

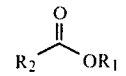

$R_2 = C_nH_{2n+2}$, $C_nH_{2n}$ $n = 1-6$
$R_1 = C_nH_{2n+2}$, $C_nH_{2n}$ $N = 1-6$

As will be understood by those skilled in the art, $SiO_2/Na_2O$ may be replaced with $SiO_2/K_2O$. $SiO_2/Na_2O$ is preferred.

To provide rheological control of the binder system on the coal there may be additionally added to the coal composition a material such as kaolin clay, starch, talc, sodium chloride and the like. Other such materials are well known to those skilled in the art and can be equivalently selected for their rheological function.

The coal component can be any type of coal, with low sulfur coal being generally preferred due to its commercial demand. The coal can be porous, non-porous, hard or soft. Coal particle size, measured as apparent diameter, can be within the range of from about 50 microns to about 0.5 inches. Preferably the apparent diameter is within the range of from about 50 microns to about 0.1 inches. By apparent diameter is meant that the coal particle will fit within a circle of the specified diameter.

The initially aqueous solution of $SiO_2/Na_2O$ preferably has a $SiO_2$ to $Na_2O$ molecular ratio within the range of from about 3.75/1.00 to about 2.00/1.00. For ease in processing it is desirable that the viscosity of the solution should not exceed 1,500 centipoise at room temperature. In a preferred solution the solids content will be within the range of from about 32% to about 44% and the specific gravity will be within the range of 1.32 to about 1.53. The amount by weight of $SiO_2/Na_2O$ aqueous solution used per pound of coal will be dependent on the physical characteristics of the coal, i.e., its porosity, its surface smoothness, the amount of additives contained within the composition, and the like. Generally speaking, however, it is believed that the most $SiO_2/Na_2O$ aqueous solution will be needed when the coal is non-porous and has a smooth surface, especially if clays and other additives are required to prevent dripping, etc. The amount of $SiO_2/Na_2O$ also may be dependent on the amount of miscellaneous additives put in. In this most difficult situation the amount of $SiO_2/Na_2O$ aqueous solution used per amount of coal, on a weight basis, is within the range of from about 0.02 parts to about 0.15 parts per single part of coal. The same parameters apply when $SiO_2/K_2O$ is substituted for $SiO_2/Na_2O$.

The water soluble surfactant used in the coal composition of this invention is used, in part, to increase the rate and extent of surface wetting of the coal particles so as to minimize the time required to achieve total wetting of the particles. Suitable surfactants for this purpose are polyether glycols, polypropylene glycols, anionic surfactants, and the like, and mixtures thereof. The surfactant should be present in the coal composition, by weight, in an amount within the range of from about 0.005 to about 0.05 parts per part of the $SiO_2/Na_2O$ aqueous solution. The same parameters apply when $SiO_2/K_2O$ is substituted for $SiO_2/Na_2O$.

Not only does the surfactant component achieve its wetting function, it also, most surprisingly, in the case of an anionic surfactant in combination with the organic ester component, causes quick gellation of the $SiO_2/Na_2O$ aqueous solution. The quick gellation time is less than 1 minute and is most important for commercial acceptance of the coal composition of the invention as gellation is a precursor to final drying. The fact that neither the surfactant component or the organic ester component alone exhibit the quick gellation effect indicates that the combination of the two results in an unpredictable synergistic effect.

The organic ester component is present in the coal compositions of this invention in an amount, by weight, within the range of from about 0.005 to about 0.20 parts per part of the $SiO_2/Na_2O$ aqueous solution. Exemplary useful esters are methyl acetate and ethyl acetate.

As mentioned previously rheological control agents may also be added to the coal compositions of this invention. Quantitatively, they are preferably present in an amount, by weight, of from about 0.01 to about 0.5 parts per part of the $SiO_2/Na_2O$ aqueous solution.

Other additives may be included in the above disclosed coal compositions. For example, wood, waxes, oxidizers, flame colorants, salts, carbonates, oxides, hydrates, water and perfumes may be added, depending upon the manufacturer's market and its demands.

The coal compositions of this invention are best prepared by mixing the coal particles with the binder system, and then adding any desired additives to the mixture of coal particles and binder system, such as sawdust, limestone, flame colorants, and the like. In the preferred compositions, liquid wax is added thereto and mixed therewith. The resultant coal and binder system is then pressed to form a pellet having a specified configuration. Pressing can be both accomplished by feeding the coal and binder system mix to an extruder which injects the mixture into a mold to form the shape of the final product, or passes it through a die in a continuous fashion. The extrusion or other processing temperature can be elevated if needed to aid in component dispersion. For example, if wax is a component then the extruder temperature can be raised to 165° F. which is sufficient to melt the wax as opposed to pre-melting the wax. Apparent drying time, at a temperature, e.g. of 75° F., will range from about 1 minute to about 12 hours depending on the exact composition.

The coal composition of the invention could also be prepared by compression molding, or briquetting.

To increase burnability, petroleum products such as wax and an oxidizer such as $NaNO_3$, $KNO_3$, peroxides, and perchlorates may be added. The $NaNO_3$ and other oxidizers are preferably crushed finely for good dispersion and mixed with the coal particles after the binder system addition. The wax can be fragmented or added as a melt after application of the binder. A preferred method is to add as a melt.

In the following examples, I and II show the lack of effectiveness when the coal composition contains the organic ester component or the surfactant component without the other one being present. Example III illustrates a coal composition of the invention.

The components used in the examples were as follows:

a. Coal—Cannel Coal from Burke Energy Corporation manually crushed to ½ inch or less apparant diameter.

b. $SiO_2/Na_2O$—"O" sodium silicate, aqueous solution from PQ Corporation.

c. Organic ester—Ethyl acetate, from Aldrich Chemical Company.

d. Surfactant—Dowfax 2Al surfactant from Dow Chemical reported to be 45% by weight sodium mono and didodecyl disulfonated diphenyl oxide in water.

The equipment used was as follows:

1. Manually driven press.
2. ¼ inch thick aluminum die with circular cut out of 0.442 inch diameter.
3. O-Haus gram balance.

EXAMPLE I

To 10 grams of "O" sodium silicate was added 1 gram of Ethyl acetate. After thorough mixing, 1 gram of this mixture was added to 10 grams of crushed Cannel Coal. The resultant coal composition was pressed in a circular mold for one hour at room temperature to form a tablet. The pressed tablet was removed without breaking, however, complete drying required 12 hours.

EXAMPLE II

To 10 grams of "O" sodium silicate was added 0.3 gram of Dowfax 2Al with stirring. One gram of the mixed components were then added to 10 grams of Cannel Coal. The coal composition was pressed in a mold for one hour to form a tablet. The tablet was observed to crumble upon removal. Additionally, the remaining binder prepared for the Example was observed to not gel any faster than "O" sodium silicate alone.

EXAMPLE III

Ten grams of "O" sodium silicate, one gram of ethyl acetate, and 0.3 gram of Dowfax 2Al were mixed to form a binder system. One gram of the resultant mixture quickly was stirred into 10 grams of Cannel coal. This coal composition was pressed formed to a tablet in a circular mold for one hour at room temperature. The pressed tablet was easily removed from the mold without crumbling. The integrity of the tablet was such that it could be easily handled without additional drying. This result was superior to the results found in Example I and II.

Not only can the binding systems disclosed as part of this invention be used to bind coal but also it is contemplated that they can be used to bind other types of particulate material.

Although the preferred embodiments of the present invention have been disclosed and described in detail above, it should be understood that the invention is in no sense limited thereby, and its scope is to be determined by that of the following claims.

What is claimed:

1. A coal composition comprising:

a. coal;

b. $Na_2SiO_3$ from an aqueous $SiO_2/Na_2O$ solution;

c. a water soluable surfactant; and d. an organic ester having the formula,

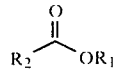

wherein, $R_1$ is $C_nH_{2n+2}$ or $C_nH_{2n}$, $R_2$ is $C_nH_{2n+2}$ or $C_nH_{2n}$, and n=1-6.

2. The composition of claim 1 wherein said coal has an apparent diameter of from about 50 microns to about 0.5 inches.

3. The composition of claim 2 wherein said coal has an apparent diameter of from about 50 microns to about 0.1 inches.

4. The composition of claim 3 wherein said coal is Cannel Coal.

5. The composition of claim 1 wherein said surfactant is sodium mono-and didodecyl disulfonated diphenyl oxide.

6. The composition of claim 1 where said organic ester is ethyl acetate.

7. The coal composition of claim 1 wherein said composition contains wax.

8. The coal composition of claim 1 wherein said composition contains a rheological control agent selected from the group consisting of kaolin clay, starch, Talc and sodium choride.

9. A coal composition comprising:

a. coal b. $K_2SiO_3$ from an aqueous $SiO_2/K_2O$ solution;

c. a water soluble surfactant; and d. an organic ester having the formula,

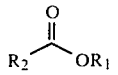

wherein, $R_1$ is $C_nH_{2n+2}$ or $C_nH_{2n}$, $R_2$ is $C_nH_{2n+2}$ or $C_nH_{2n}$, and $n=1-6$.

* * * * *